United States Patent [19]

Holl et al.

[11] Patent Number: 4,836,459

[45] Date of Patent: Jun. 6, 1989

[54] APPARATUS FOR FEEDING ROLLING MILLS, PARTICULARLY FOR OIL SEED

[75] Inventors: Wolfgang Holl, Gudehandviertel; Gerhard Weilandt, Hamburg; Heinz Thiem, Uetersen/Holstein, all of Fed. Rep. of Germany

[73] Assignees: Gebruder Bauermeister & Co.; Verfahrenstechnik GmbH & Co., both of Hamburg, Fed. Rep. of Germany

[21] Appl. No.: 112,072

[22] Filed: Oct. 26, 1987

[30] Foreign Application Priority Data

Oct. 25, 1986 [DE] Fed. Rep. of Germany ..... 3636461

[51] Int. Cl.[4] ..... B02C 4/28

[52] U.S. Cl. ..... 241/225; 241/232

[58] Field of Search ..... 241/37, 235, 236, 294, 241/295, 293, 222, 225, 231, 159, 186.4, 290, 232, 63, 64, 34, 101.7, 101 D, 32

[56] References Cited

U.S. PATENT DOCUMENTS

| | | | |
|---|---|---|---|
| 387,438 | 8/1888 | Parker | 241/225 |
| 388,968 | 9/1888 | Gray | 241/64 |
| 1,156,373 | 10/1915 | Ryther | 241/225 X |
| 1,396,108 | 11/1921 | Gilmore | 241/225 X |
| 1,603,763 | 10/1926 | Griffin | 241/225 X |
| 1,683,042 | 9/1928 | Krogan | 241/225 X |
| 1,826,891 | 10/1931 | Krogan | 241/225 |
| 2,008,852 | 7/1935 | Diaz | 241/225 X |
| 2,125,993 | 8/1938 | Dellinger | 241/101 D X |
| 3,099,406 | 7/1963 | Kautz | 241/231 X |

FOREIGN PATENT DOCUMENTS

| | | | |
|---|---|---|---|
| 3404730 | 9/1984 | Fed. Rep. of Germany . | |
| 146910 | 1/1882 | France | 241/225 |

*Primary Examiner*—Mark Rosenbaum

*Attorney, Agent, or Firm*—Staas & Halsey

[57] ABSTRACT

The apparatus for feeding rolling mills, particularly for oil seed, comprises two rotatable feed rollers located in a feed mechanism housing above the rolling mill. The feed rollers are substantially vertically oriented and are rotatable in opposite directions. The housing wall running in the longitudinal direction of the feed rollers engages closely on an upwardly moving circumferential portion of the lower feed roller, in order to ensure that no material passes through in this area. All the material to be ground passes through the gap. Since the gap is formed by two feed rollers, whose surfaces move in the direction of the material, no lumps and the like collect upstream of the gap and consequently cause a non-uniform material flow. The apparatus permits a very uniform flow and simultaneously breaks up lumps.

16 Claims, 2 Drawing Sheets

APPARATUS FOR FEEDING ROLLING MILLS, PARTICULARLY FOR OIL SEED

BACKGROUND OF THE INVENTION

The present invention relates generally to an apparatus for feeding rolling mills.

Such an apparatus is known from DE-OS No. 34 04 730. The two feed rollers of this known apparatus are driven in the same direction. The rotation direction is defined in such a way that the material supplied from above passes from the top surface of one feed roller to the top surface of the other feed roller rotated in the same direction, so that the material being ground is distributed as uniformly as possible. The quantity of the entrained or carried along material is achieved through a slide, which is also known as a slide bar, positioned above the first feed roller. This slide is fixed, i.e. it can not move in relative manner with the material to be ground. As a result said material can collect in front of the slide, which reduces the flow rate or throughput, which also becomes non-uniform.

SUMMARY OF THE INVENTION

An object of the present invention is to provide an apparatus for feeding rolling mills, which ensures a uniform, continuous flow of the material to be ground and which is supplied to the rolling mill.

Apart from a uniform and continuous dosing, the material to be ground must also be broken up if lumps or the like form. This problem is solved by providing feed rollers which are substantially vertically superimposed and are rotated in opposite directions. A housing wall of the feed mechanism runs in the longitudinal direction of the feed rollers and engages closely to the upwardly moving circumferential portion of the lower feed roller.

Due to the fact that there are two feed rollers driven in opposite directions, the material being ground is necessarily drawn in the gap between said rollers. In practice, according to the invention, the slide is replaced by a feed roller, whose surface moves in relative manner with the material flow. The two superimposed feed rollers move in the direction of the material to be dosed and broken up. This avoids the collection of lumps upstream of the gap, because said lumps are broken up. A constant volume flow is produced, which is independent of the specific gravity. The material flow is of a uniform and not a pulsating nature, so that the following rolling mill is supplied with a correspondingly continuous, uniform flow of material to be ground.

BRIEF DESCRIPTION OF THE DRAWINGS

The invention is described in greater detail hereinafter relative to a non-limitative embodiment and the attached drawings, showing.

DETAILED DESCRIPTION OF THE INVENTION

Figure 1:
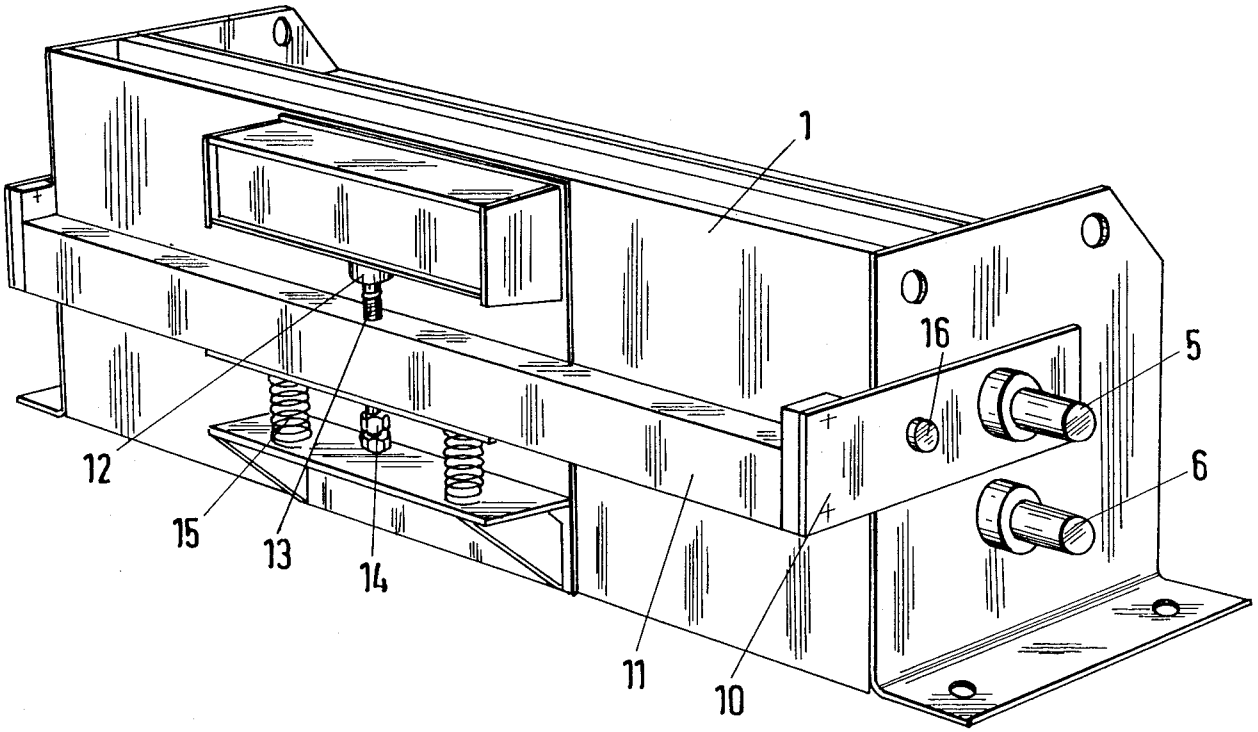
FIG. 1 A perspective of an embodiment of a first preferred apparatus according to the invention.

The apparatus shown in the drawings comprises a feed mechanism housing 1, in which are mounted with the aid of shafts 5 and 6, two feed rollers 2 and 3, between which is formed a gap 4.

Figure 2:
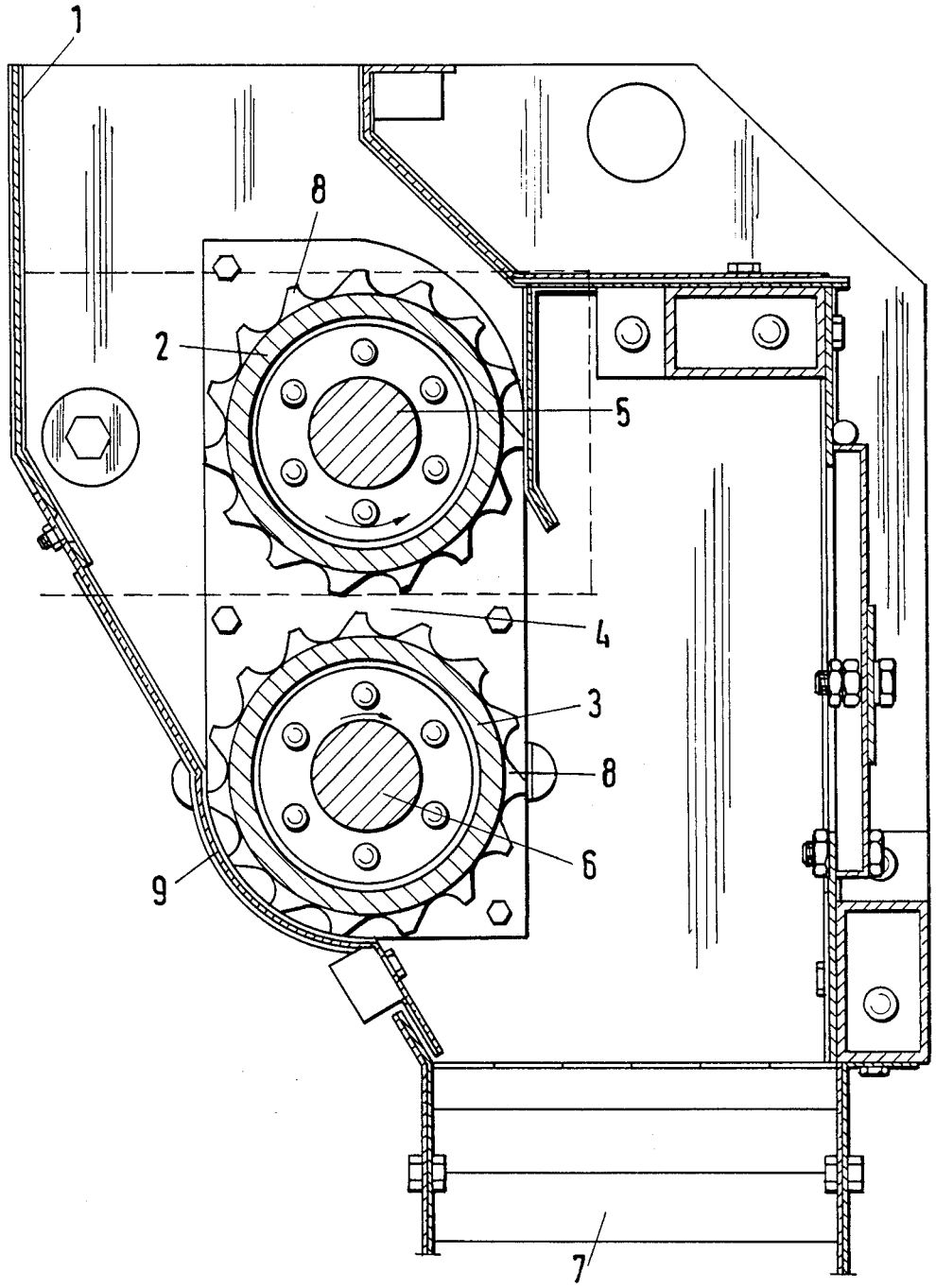
FIG. 2 An enlarged cross-section view the essential part of the apparatus according to FIG. 1.

On each feed roller are formed tooth profiles 8, which have a limited angular momentum in the longitudinal direction, i.e. form a corresponding helical shape. As can be gathered from FIG. 2, the teeth of the two feed rollers are displaced against one another in cross-section. The tooth profiles 8 can be located on interchangeable sleeves on the particular feed roller. It is readily apparent that the tooth shape must be adapted to the particular material to be ground. The cross-sectionally apparent displacement of the tooth profiles 8 can also be adjusted for adapting to the material to be ground. Each feed roller 2, 3 is mounted with the aid of a shaft 5 and 6.

At 9, the feed mechanism housing engages tightly on the lower feed roller, so that in this area it prevents an uninfluenced passage of the material to be ground. The material, which has entered said area as a result of gravity, is entrained by feed roller 3 and fed into the roller gap 4.

It can be gathered from FIG. 1 that shaft 6 of the lower feed roller 3 is mounted in the two side walls of the feed mechanism housing 1. Shaft 5 of the upper feed roller 2 is mounted in two swing arms 10, whose fulcrum is indicated at 16 on the side walls of housing 1. The two swing arms are interconnected by a crossbar 11. In the latter is fitted a setscrew or spindle 13, which can be moved up and down by rotation and fixing nuts are indicated at 14. The movement of swing arms 10 with the crossbar 11 takes place counter to the tension of springs 15.

Above the setscrew or spindle 13 is located a pneumatic cylinder 12 for closing the gap between the feed rollers when operation is at a standstill.

During operation, the material to be ground is fed from above by gravity into the feed mechanism housing 1, where it is taken up by the feed rollers 2 and 3, which are rotated in opposite directions and is drawn into gap 4. There is a dosing as a function of the size of the gap and the circumferential speed of the feed rollers. At the same time lumps and the like are broken up, because the two surfaces of feed rollers 2, 3 move with the material in the direction in which feeding is to take place.

The correspondingly selected and set tooth profiles additionally ensure that the feed flow is rendered uniform.

If there is a foreign body, e.g. a stone in the material to be ground, the mounting of the upper roller with the aid of swing arms 10 prevents damage or desctruction. The upper roller is moved upwards counter to the action of springs 15 until the foreign body has left gap 4. This movement can also be used as an indication, which informs the operator that a foreign body has been moved through gap 4.

The setscrew or spindle 13 is used for adjusting the gap 4. The corresponding end of the setscrew 13 engages on the end of the piston of a pneumatic piston and cylinder unit 12. The ends of the piston and the setscrew form the fixing or adjusting point.

If operation is interrupted, then the pneumatic piston and cylinder unit 12 is operated, in order to close gap 4, i.e. the springs 15 make it possible to move the crossbar 11 upwards and therefore the feed roller 2 downwards. The not shown rolling mill is connected at 7 (FIG. 2) to the feed mechanism housing 1.

What is claimed is:

1. A apparatus for feeding a rolling mill, particularly for oil seed, comprising:

a feed mechanism housing having a longitudinal wall and opposite sidewalls;

upper and lower feed rollers positioned in the feed mechanism housing above a rolling mill, wherein the feed rollers are substantially vertically aligned and rotatable in opposite directions, the longitudinal wall of the housing running in the longitudinal direction of the feed rollers and engaging closely on an upwardly moving circumferential portion of the lower feed roller, the upper and lower feed rollers having a gap therebetween during feeding;

the upper and lower feed rollers being mounted on shafts, and the upper feed rollers being mounted on swing arms having fulcrums located on the side walls of the housing, the swing arms being interconnected by a crossbar having upper and lower surfaces and including means for adjusting the gap between the feed rollers, movement of the crossbar for opening the gap being opposed by at least one spring extending between the lower surface of the crossbar and the feed mechanism housing.

2. An apparatus according to claim 1, further comprising means for closing the gap between the upper and lower feed rollers when operation ceases.

3. An apparatus according to claim 2, further comprising means for automatically increasing the size of the gap between the upper and lower feed rollers to allow passage of foreign bodies.

4. An apparatus according to claim 3, wherein the upper and lower feed rollers have an interchangeable sleeve.

5. An apparatus according to claim 3, wherein the upper and lower feed rollers are provided with a tooth profile having an angular momentum running in a longitudinal direction.

6. An apparatus according to claim 2, wherein the upper and lower feed rollers are provided with a tooth profile having an angular momentum running in a longitudinal direction.

7. An apparatus according to claim 2, wherein the upper and lower feed rollers have an interchangeable sleeve.

8. An apparatus according to claim 2, wherein the means for closing the gap comprises a pneumatic cylinder disposed between the upper surface of the crossbar and the feed mechanism housing, said cylinder acting to move the crossbar and thus the upper feed roller to open and close the gap.

9. An apparatus according to claim 8, wherein the upper and lower feed rollers are provided with a tooth profile having an angular momentum running in a longitudinal direction.

10. An apparatus according to claim 8, wherein the feed rollers have an interchangeable sleeve.

11. An apparatus according to claim 1, wherein the upper and lower feed rollers are provided with a tooth profile having an angular momentum running in a longitudinal direction.

12. An apparatus according to claim 11, wherein the feed rollers have an interchangeable sleeve.

13. An apparatus according to claim 11, wherein the tooth profiles of the upper and lower feed rollers are cross-sectionally displaced against one another.

14. An apparatus according to claim 13, wherein the feed rollers have an interchangeable sleeve.

15. An apparatus according to claim 1, wherein the upper and lower feed rollers have an interchangeable sleeve.

16. An apparatus according to claim 1, further comprising means for increasing the size of the gap between the upper and lower feed rollers to allow passage of foreign bodies.

* * * * *